US006609677B2

(12) United States Patent
Seybold et al.

(10) Patent No.: US 6,609,677 B2
(45) Date of Patent: Aug. 26, 2003

(54) BEVEL RIBBED CORE

(75) Inventors: James M. Seybold, Centerville, OH (US); Richard D. Puckett, Miamisburg, OH (US)

(73) Assignee: NCR Corporation, Dayton, OH (US)

( * ) Notice: Subject to any disclaimer, the term of this patent is extended or adjusted under 35 U.S.C. 154(b) by 93 days.

(21) Appl. No.: 10/061,144

(22) Filed: Oct. 29, 2001

(65) Prior Publication Data

US 2003/0080238 A1 May 1, 2003

Related U.S. Application Data

(63) Continuation-in-part of application No. 09/694,410, filed on Oct. 23, 2000, now Pat. No. 6,425,551.

(51) Int. Cl.[7] ..... B65H 75/14
(52) U.S. Cl. ..... 242/611.2; 400/242; 400/613
(58) Field of Search ..... 242/611.2, 597.2, 242/597.6; 400/242, 613

(56) References Cited

U.S. PATENT DOCUMENTS

| | | | |
|---|---|---|---|
| 2,585,999 | A | 2/1952 | Puckett et al. |
| 2,889,123 | A | 6/1959 | Hayden |
| 3,042,180 | A | 7/1962 | Bishop |
| 3,207,454 | A | 9/1965 | Bendar |
| 4,610,555 | A | 9/1986 | DiLuco |
| 4,729,526 | A | 3/1988 | Becker et al. |
| 5,415,362 | A | 5/1995 | Lorenzo |
| 5,439,303 | A | 8/1995 | Alday |
| 5,833,377 | A | 11/1998 | Keller et al. |

*Primary Examiner*—John Q. Nguyen
(74) *Attorney, Agent, or Firm*—Francis L. Conte

(57) ABSTRACT

A core includes a tubular body for supporting a wound sheet roll on a spindle. The body includes an annular outer surface for receiving the sheet roll, and an annular inner surface defining a bore for receiving the spindle. A plurality of ribs project inwardly from the body inner surface and extend axially between opposite first and second openings for nesting in the corresponding slots in the spindle. Each of the ribs includes a beveled fork for frictionally engaging a corresponding one of the spindle slots to frictionally retain the core axially thereon.

23 Claims, 5 Drawing Sheets

BEVEL RIBBED CORE

This application is a continuation-in-part of U.S. patent application Ser. No. 09/694,410; filed Oct. 23, 2000, now U.S. Pat. No. 6,425,551.

BACKGROUND OF THE INVENTION

The present invention relates generally to printers, and, more specifically, to replaceable printer rolls therein.

A typical printer includes a roll of printing paper upon which any desirable information may be printed. The paper is wound in a continuous sheet on a supporting core, and the core is mounted on a driven spindle in the printer. In a thermal printer, the core includes thermal transfer ribbon wound thereon which is thermally activated during printing.

When the ribbon is depleted on the core, the empty core is removed from the spindle and replaced with a fully wound core for returning the printer to service.

The core typically includes retaining features for accurately retaining the core axially on the spindle in proper alignment with the printing mechanism, and circumferentially retaining the core around the spindle for rotating therewith as the spindle is driven during printer operation.

In one conventional design, the spindle includes three axial slots around the perimeter thereof which axially receive corresponding straight axial ribs projecting inwardly along the inner surface or bore of the core. The core may be easily inserted axially over the spindle by engaging the corresponding ribs and slots, with the ribs providing circumferential retention around the spindle for being driven in rotation therewith.

However, additional features are required for locking the core in axial position over the spindle and preventing its unintended liberation therefrom or misalignment thereon. This increases the complexity of the core and spindle assembly, and correspondingly increases the cost thereof.

Cost is a significant factor in the manufacture and use of printer rolls and must be minimized for maintaining competitive advantage in the market for supplying replacement printing rolls.

U.S. patent application Ser. No. 09/694,410, now U.S. Pat. No. 6,425,551 discloses a low cost core having three bowed ribs which frictionally engage the respective slots for retaining the core on the spindle. The primary core embodiment illustrated in FIGS. 1–5 of that application has been sold by the present assignee and in public use in this country for more than a year now.

The bow ribbed core is made of molded plastic, and experience in the field has now shown that random variations in rib dimensions due to the molding process exceeds the few mil tolerances of the drawing specification therefor and produces some cores with reduced frictional retention force from the out-of-spec bowed ribs. When such cores are used in a new printer having a horizontal spindle, the friction force is usually sufficient to retain the core on the spindle.

However, as the spindle wears during use it may become loose and can tilt downwardly a few degrees. That small tilt may then permit gravity to exceed the friction retention force of the ribs and allow the core to slide out of proper position on the spindle.

More expensive plastic may be used to accommodate increased bending loads in the ribs for increasing friction retention force, but that would reduce the competitive advantage of the product. And, increasing the bending loads leads to higher stress in the plastic ribs, and may cause premature fatigue failure of such bowed ribs.

Accordingly, it is desired to provide an improved core for winding sheet rolls thereon having corresponding retention features for being mounted to a supporting spindle.

BRIEF SUMMARY OF THE INVENTION

A core includes a tubular body for supporting a wound sheet roll on a spindle. The body includes an annular outer surface for receiving the sheet roll, and an annular inner surface defining a bore for receiving the spindle. A plurality of ribs project inwardly from the body inner surface and extend axially between opposite first and second openings for nesting in the corresponding slots in the spindle. Each of the ribs includes a beveled fork for frictionally engaging a corresponding one of the spindle slots to frictionally retain the core axially thereon.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DETAILED DESCRIPTION OF THE INVENTION

Figure 1:
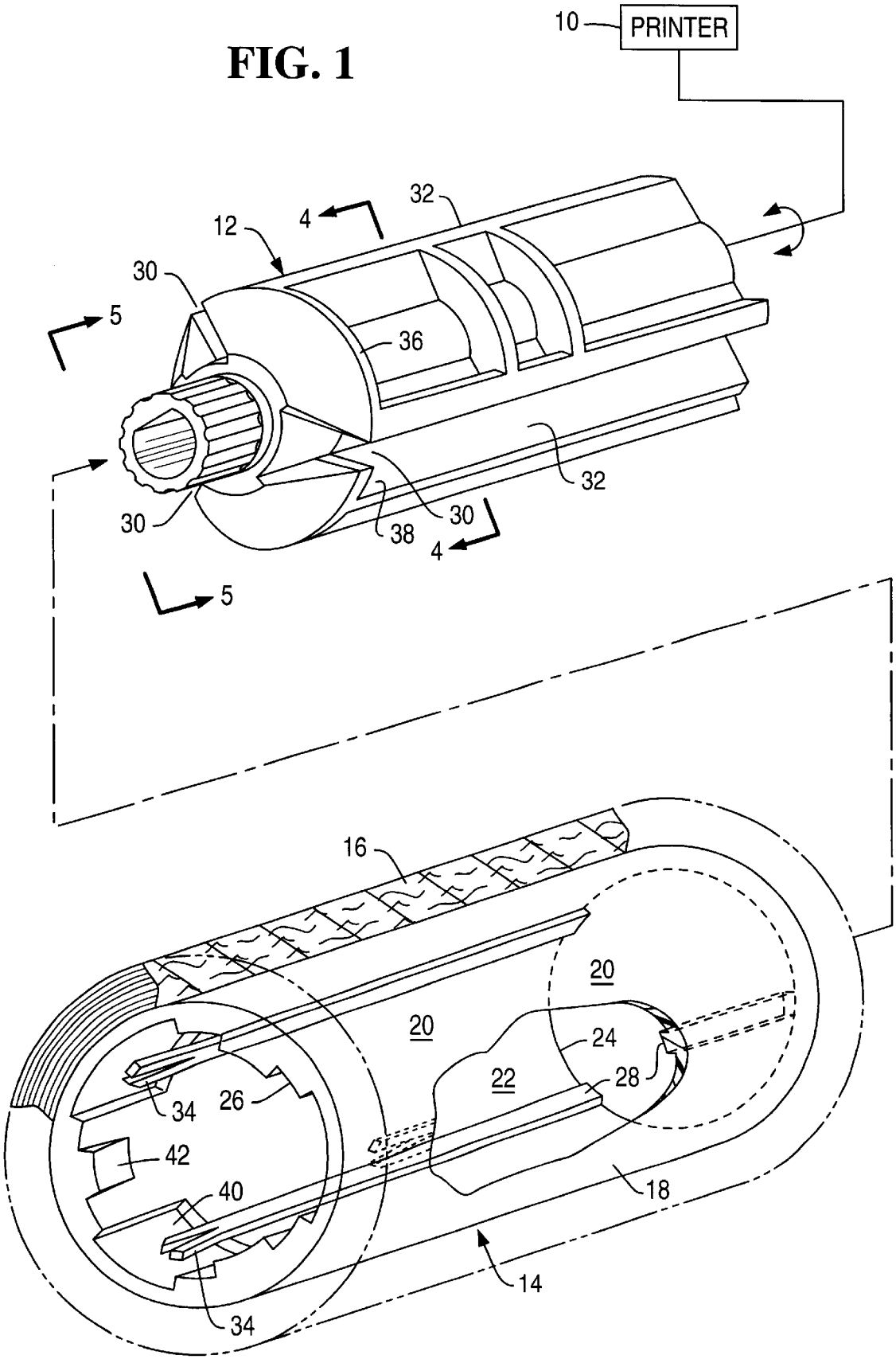
FIG. 1 is an isometric exploded view of a core for supporting a sheet roll assembled on a spindle in a printer in accordance with an exemplary embodiment.

Illustrated schematically in FIG. 1 is a printer 10 which may have any conventional configuration including a rotary spindle 12 suitably mounted therein for driven rotation around its axial centerline axis during operation.

In accordance with a preferred embodiment of the present invention, a cylindrical core 14 is configured for supporting a wound sheet roll 16 on the spindle 12 during operation. The core 14 is axially and circumferentially retained or locked onto the spindle 12 in a predetermined position so that as the spindle is rotated during operation the sheet roll 16 is unwound therefrom for being printed thereon in any conventional manner.

For example, the sheet roll 16 may be formed of conventional thermal transfer ribbon or paper for cooperating with a thermal printing head which thermally produces any desired printing indicia thereon, such as an itemized receipt for various commercial transactions.

The core illustrated in FIG. 1 has a tubular body 18 which includes an annular or cylindrical outer surface 20 for receiving the sheet roll 16 wound therearound in any conventional manner. The body also includes a generally cylindrical or annular radially inner surface 22 which defines a cylindrical bore for receiving the spindle therein upon assembly. The tubular body also includes a first or aft circular opening 24 at one end thereof, and a generally circular forward or second opening 26 at an axially opposite end thereof.

The body also includes a plurality of circumferentially spaced apart ribs 28 projecting radially inwardly from the inner surface 22, and extending axially between the first and second openings 24,26 for nesting in corresponding axially straight slots 30 in the outer perimeter of the spindle 12. The ribs 28 are sized in radial height to project over a suitably small portion of the inner diameter of the core for radial insertion into the correspondingly radially deeper slots 30 in the spindle for providing circumferential retention of the core on the spindle during operation. As the spindle 12 rotates in the printer, corresponding sidewalls 32 defining the slots 30 circumferentially engage the sides of the ribs 28 for rotating the core simultaneously with the spindle for in turn unwinding and dispensing the sheet roll 16 wound on the core.

In accordance with one feature of the present invention, each of the ribs 28 includes a distal end in the form of a fork 34 disposed inside the core second opening 26. The fork extends axially outwardly from the straight main portion of the rib, and includes two circumferentially splayed apart prongs or tines. The tines have circumferentially outwardly facing side surfaces which are bowed outwardly relative to the remaining, un-forked portion of the rib.

Figure 2:
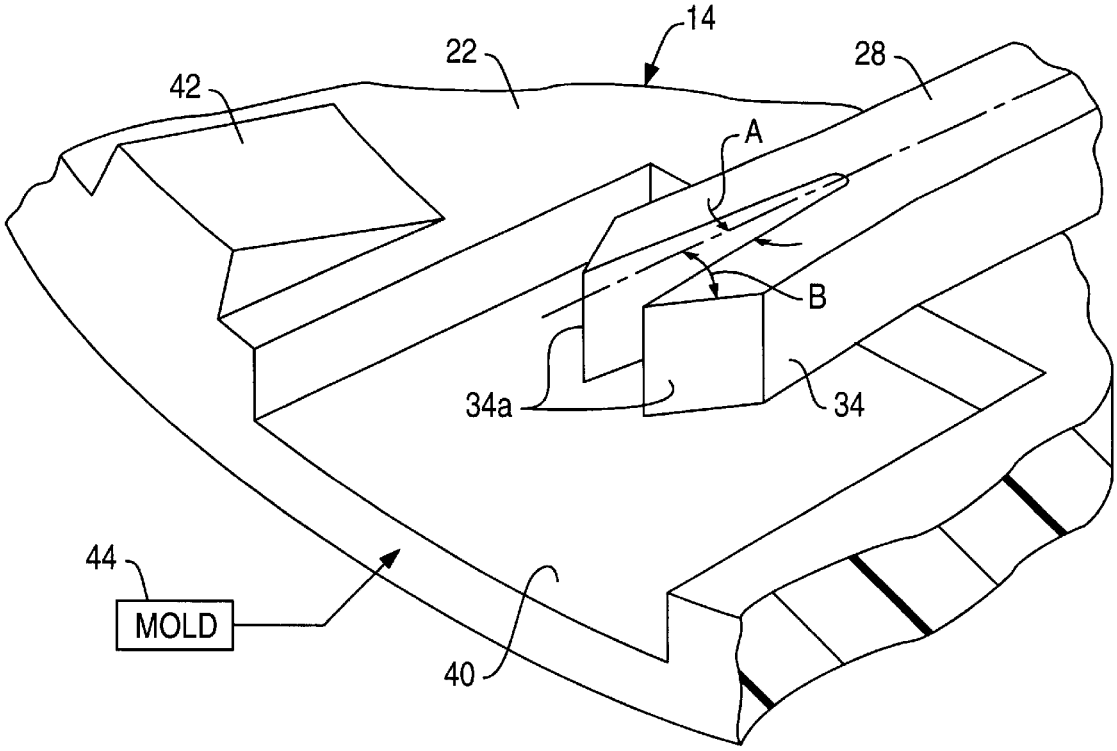
FIG. 2 is an enlarged, isometric view of the forward portion of the core illustrated in FIG. 1 including details of a beveled forked rib, underlying notch, and retention wedge produced by molding in accordance with an exemplary embodiment of the present invention.

FIG. 2 illustrates in more detail a preferred form of the fork tines 34. The two tines are each preferably straight, but are splayed laterally apart from the main rib at respective splay angles A of about 5° for a total included divergence angle therebetween of about 10°.

Each tine has a corresponding beveled end face 34*a* with an acute bevel or inclination angle B measured from the axial or longitudinal axis of the corresponding rib 28. The pair of tines defining each fork 34 have oppositely beveled end faces 34*a* so that the end faces diverge away from each other axially between the second and first openings of the core, or converge together toward the second opening from inside the core.

Figure 3:
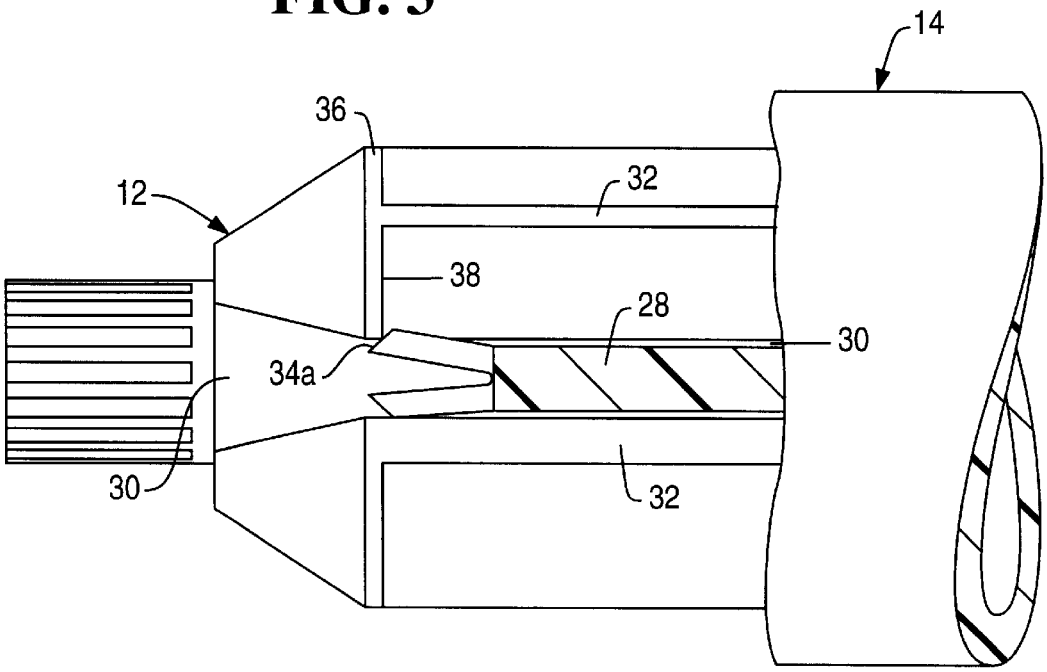
FIG. 3 is a partly sectional side view of one of the bevel forked ribs illustrated in FIG. 4 cooperating with the spindle.

The spindle 12 illustrated in FIGS. 1 and 3 includes a conical forward flange 36 having a flat aft surface integrally joined with the corresponding sidewalls 32 of the spindle. As shown in end view in FIGS. 4 and 5, the spindle sidewalls 32 may be arranged in various configurations for defining the corresponding slots 30 therebetween.

Figure 6:
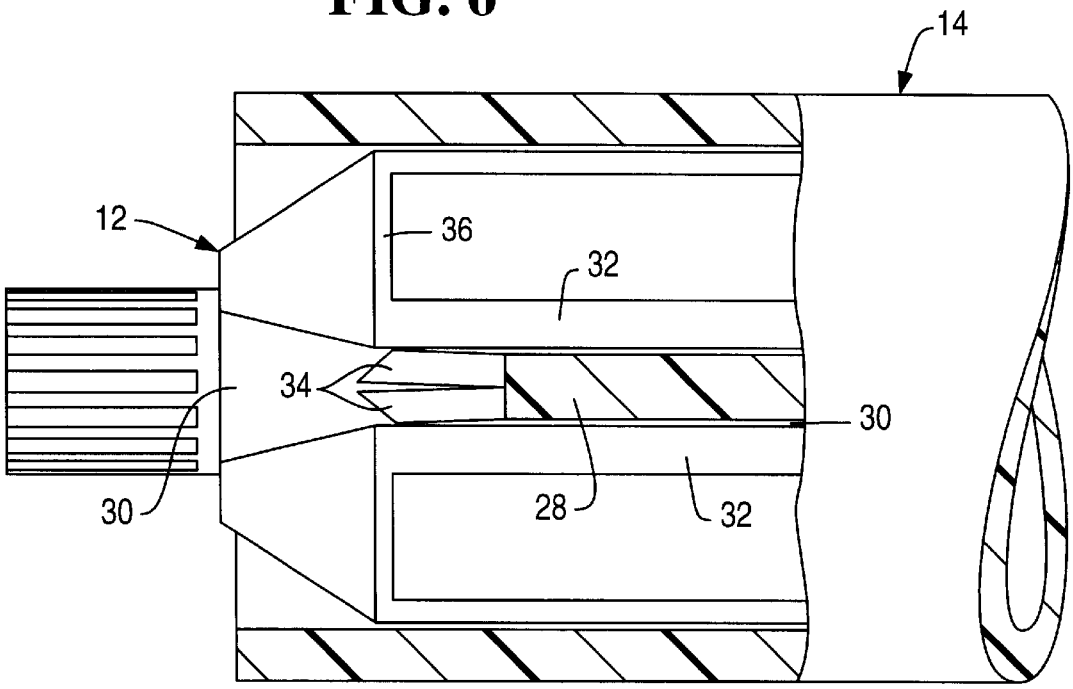
FIG. 6 is a partly sectional, top view of the forward portion of the spindle mounted core illustrated in FIG. 5 showing a forked core rib mounted in engagement in a corresponding spindle slot and taken along line 6—6.

For example, two of the sidewalls 32 at the twelve o'clock position extend parallel to each other along corresponding chords of the spindle to define the corresponding top slot 30 therebetween having two opposing sidewalls against which both tines of the fork 34 may frictionally engage as illustrated in FIG. 6.

Figure 4:
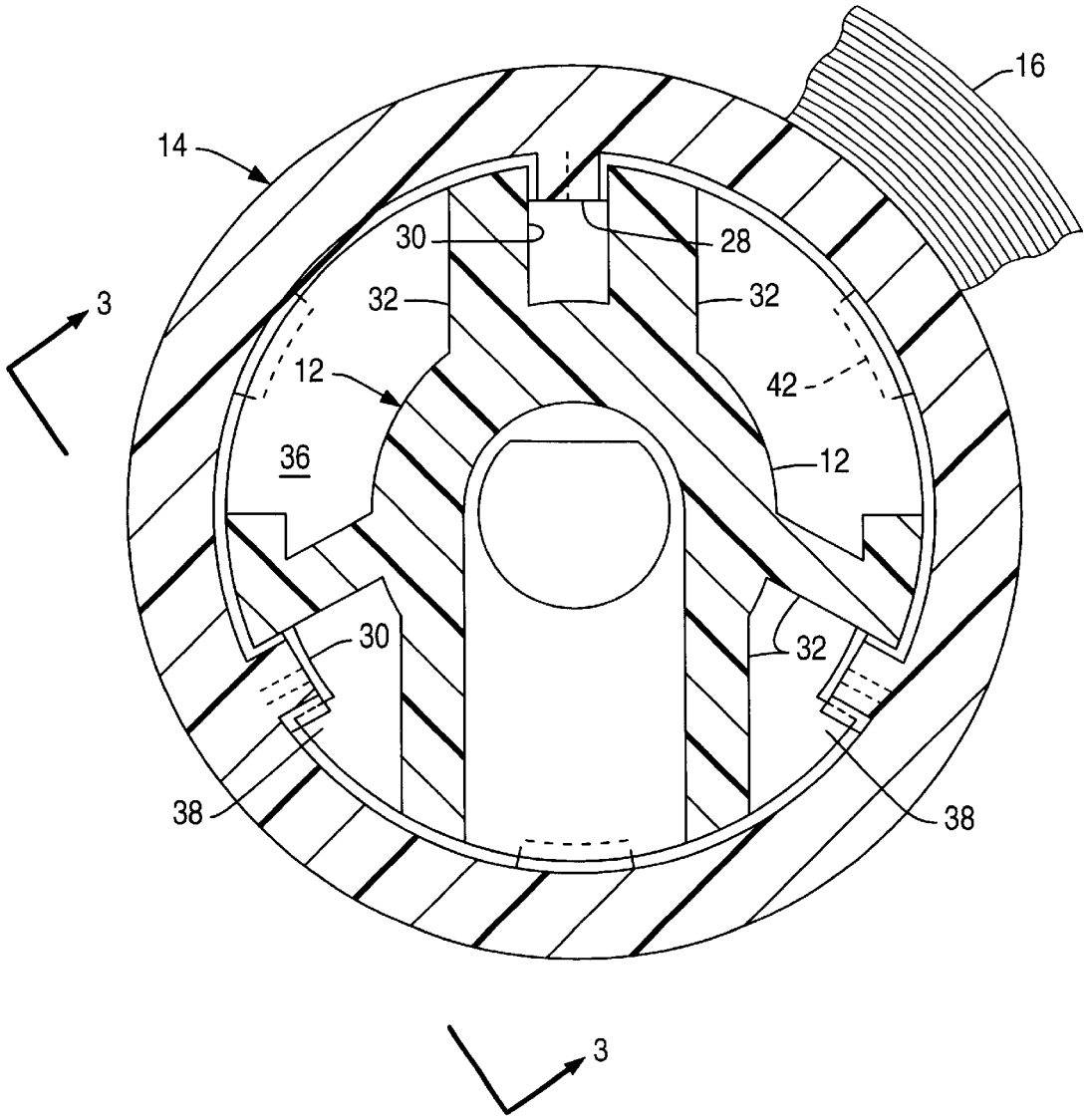
FIG. 4 is an aft-facing-front elevational sectional view of the spindle mounted core illustrated in FIG. 1 and taken generally along line 4—4.
Figure 5:
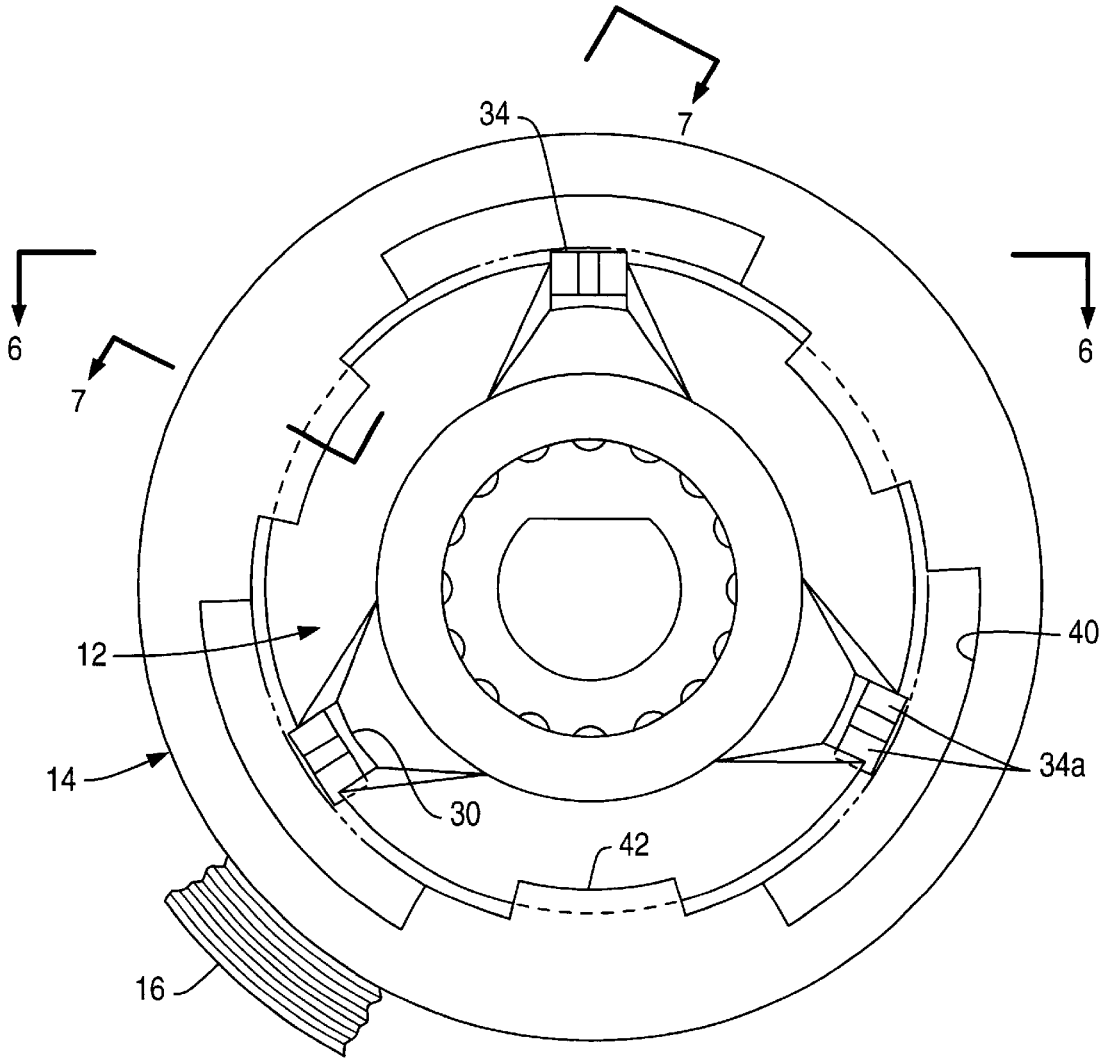
FIG. 5 is a front elevational view of the spindle mounted core illustrated in FIG. 1 and taken generally along line 5—5.

The remaining two bottom spindle slots 30 illustrated in FIG. 4 at generally the four o'clock and seven o'clock positions are defined by a generally radially extending sidewall 32 and cooperating chordally extending sidewall forming an outwardly diverging slot therebetween. The spindle forward flange 36 includes narrow entrances for the spindle slots 30 sized for receiving the corresponding core ribs 28 and for compressing together the splayed fork tines as shown in FIGS. 3 and 5.

In the exemplary spindle slot configuration illustrated in FIG. 3, one sidewall 32 is coextensive with the slot formed through the conical forward flange 36, with the other sidewall 32 being offset circumferentially from the common slot 30 in the forward flange 36. This construction provides a recess or step 38 behind the forward flange 36 at the entrance of the corresponding slot 30. As shown in FIG. 4, the two bottom slots 30 include the corresponding steps 38, and the single top slot does not.

Accordingly, the conical forward flange 36 may be used to advantage for defining a converging entrance to each of the three spindle slots 30 effective for compressing together the three sets of splayed fork tines in a cam action as the tines slide along the slot sides during mounting. The tines are sized in length so that when the corresponding beveled end face 34*a* in one tine pair is driven inwardly past the aft side of the forward flange 36, the corresponding fork tine expands slightly to position the middle of the end face 34*a* slightly behind the forward flange to provide a retaining detent feature as illustrated in FIGS. 2–5.

As shown in FIG. 3, one fork tine is compressed against the lower slot sidewall 32 in reaction to compression of the opposite fork tine whose end face 34*a* axially abuts the step 38 for providing the releasable detent latch. The fork end face 34*a* is suitably beveled to engage the step edge at the flange and provide axial retention force to lock the core onto the spindle.

The inclination angle B of the two beveled end faces 34*a* is preferably in the range of about 15°–30°, and is about 22° in the particular embodiment illustrated. This preferred bevel provides both a flat cam surface along the end face to compress the tines together, and an effective axial locking force. Yet, the acute bevel angle permits the core to be simply pulled off the spindle as the step edge compresses the fork tine to clear that edge.

The detent feature provided by the beveled tines illustrated in FIG. 3 is found at both bottom slots 30 illustrated in FIGS. 2 and 4 for doubling the retention force. Since no step and corresponding detent is found in the top slot illustrated in FIGS. 2, 4, and 5, the two top tines merely compress together to frictionally engage the opposite sidewalls 32 and provide additional retention force.

In the preferred embodiment illustrated in FIG. 1, the core inner surface 22 includes a recessed notch or undercut 40 adjacent the second opening 26 and preferably extending axially inwardly therefrom. The bowed distal end or fork 34 of the rib 28 is preferably cantilevered or freely suspended radially inwardly or inboard over the notch 40. The fork tines extend axially outwardly from the main body of the rib at its distal end over the notch 40 for being freely compressible as they slide through the slot entrances.

The fork 34 is illustrated in FIG. 1 in its nominal uncompressed configuration, and is elastically flexible or resilient for being circumferentially compressed as the core is assembled or inserted over the spindle 12 in the direction illustrated in FIG. 1. During assembly, the core ribs 28 are aligned with corresponding ones of the spindle slots 30 and simply pushed axially over the spindle as the ribs 28 slide without obstruction through the corresponding spindle slots.

As the rib fork 34 reaches the forward end of its cooperating spindle slot, it is circumferentially compressed together by the entrance slot in the forward flange 36. The two bottom forks illustrated in FIGS. 2 and 4 then snap slightly open to latch corresponding ones of the two end faces in detent contact with the corresponding step edges.

As best illustrated in FIGS. 3 and 6, the forks 34 are compressed at the entrances of the spindle slots 30 by the cooperating sidewalls 32. The remaining portions of the ribs 42 are suitably smaller in circumferential width than that of the spindle slots 30 so that they may be assembled without interference while still providing a circumferential retention feature at a corresponding one of the sidewalls that engages the rib during rotary operation.

In the preferred embodiment illustrated in FIGS. 1–6, the tines of the fork 34 have equal radial height with each other and with the remaining portion of the corresponding rib 28, and have corresponding circumferential widths collectively no greater than the width of the remaining portion of the rib. In this way, the fork 34 may be fully circumferentially compressed or collapsed as the rib is axially inserted through the corresponding spindle slot without the fork preventing complete assembly of the core in the required axial position on the spindle.

However, it is desirable to introduce in the core an additional feature for preventing excessive axial insertion of the core over the spindle. In the preferred embodiment illustrated in FIG. 1, the core 14 preferably also includes at least one wedge 42 projecting radially inwardly from the inner surface 22 of the core at the second opening 26 at which the fork 34 is located. The wedge 42 may have any suitable shape and is preferably inclined radially inwardly and aft toward the first opening 24 for locally reducing the inner radius or diameter of the core at the second opening for axial abutting a corresponding portion of the forward end of the spindle to limit aft-directed assembly and movement of the core onto the spindle during core mounting.

Figure 7:
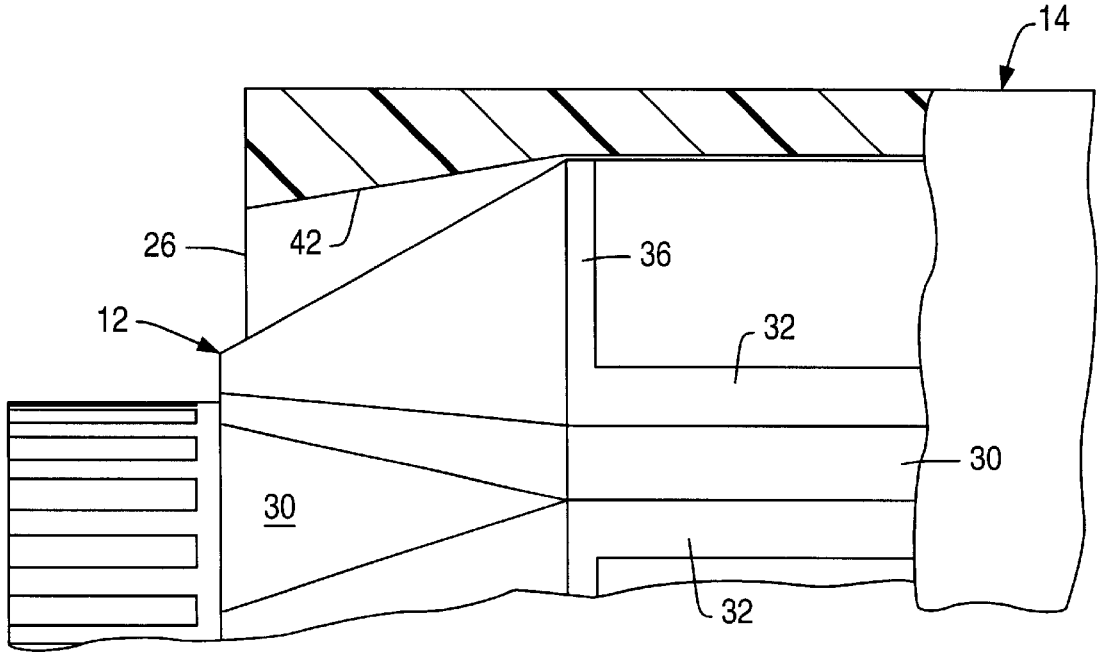
FIG. 7 is a partly sectional view of the forward end of the spindle mounted core illustrated in FIG. 5 illustrating an exemplary retention wedge therein, and taken along jog line 7—7.

As shown in FIGS. 1 and 5, the wedge 42 is preferably spaced circumferentially from adjacent ribs 28 to uncouple the frictional axial retention feature from the axial insertion limiting feature. FIG. 7 illustrates in more detail a preferred form of the wedge 42 which axially abuts a corresponding portion of the spindle 12 at a maximum diameter thereof disposed near the forward end of the spindle. In this way, the inner diameter of the majority of the core may be slightly larger than the maximum outer diameter of the spindle for permitting unrestrained axial insertion mounting of the core over the spindle until the spindle axially abuts the decreasing inner diameter of the core created by the wedge 42 at the forward second opening 26 thereof.

FIG. 7 illustrates the fully mounted position of the core 14 over the spindle 12 with the wedge 42 axially abutting the forward end of the spindle preventing further axial insertion. FIG. 6 illustrates the corresponding position of the compressed top fork 34 which provides frictional retention force on the opposite circumferential sides thereof. And, FIG. 3 illustrates the corresponding position of the latched two bottom forks for providing detent retention.

As shown in FIGS. 1 and 6, each rib 28 includes a substantially axially straight major portion extending from the core first opening 24 to the notch 40 adjacent the core second opening 26. And, the individual tines of the fork 34 are preferably axially straight over the notches but splayed or bent circumferentially outwardly from the sides of the rib straight portion with corresponding obtuse side angles slightly less than 180°. In this way, each fork 34 smoothly blends with the otherwise straight sides of the rib 28 for providing a smooth transition and cam action as the fork is compressed by the sides of the spindle slot during mounting.

In the various embodiments of the core and its beveled ribs 28, an improved and simplified combination of the core and spindle is provided. The spindle slots 30 may be relatively simple in configuration and configured merely for receiving the respective core ribs, and compressing the corresponding fork 34 in simple cam action to latch the detent beveled end faces 34*a*. And, the cooperating wedge 42 provides a simple feature for axially abutting the forward end of the spindle circumferentially between adjacent ones of the slots 30 to prevent excessive axial mounting movement of the core on the spindle.

In the exemplary embodiment illustrated in FIG. 1, the spindle includes three slots 30, and the core correspondingly includes three of the ribs 28 configured and positioned for being simultaneously inserted into the corresponding slots during mounting assembly. And, each of the ribs 28 preferably includes the forked distal end 34 cantilevered over corresponding notches in the core inner surface.

Furthermore, the core illustrated in FIGS. 1 and 2 preferably includes three of the wedges 42 spaced circumferentially between corresponding pairs of the forked ribs 28 for providing multiple axial stop limits between the core and spindle.

The spindle slots 30 illustrated in FIG. 1 are preferably equiangularly spaced apart from each other with a 120° pitch. Correspondingly, the three forked ribs 28 of the core are also equiangularly circumferentially spaced apart from each other at a 120° pitch, with the three wedges 42 being similarly spaced apart from each other at the 120° pitch. And, each of the wedges is preferably equiangularly spaced apart between corresponding pairs of the forked ribs at a 60° pitch therewith.

In this way, the core has symmetrical ribs and may be mounted over the spindle in any of three possible rotary orientations and axially locked in position by the cooperating three sets of forks 34 and wedges 42. Each fork 34 has symmetrical tines so that any one tine is available to effect the detent latching with the two oppositely configured bottom slots illustrated in FIG. 4, as well as being simply compressed at the entrance of the top slot without latching thereat.

The preferred embodiment of the core illustrated in FIG. 1 is relatively simple in configuration and is in the form of a cylindrical tube with the retention features preferably molded therein in a unitary construction. More specifically, an enlarged forward portion of the core 14 is illustrated in more detail in FIG. 2. The core is preferably formed of a suitable plastic which may have any conventional composition capable of being molded to shape. The core is preferably molded using any conventional molding apparatus 44 in a unitary assembly including the three ribs 28 and three wedges 42 projecting radially inwardly from the inner surface 22, and the corresponding forks 34 extending axially at the distal ends of the corresponding ribs and cantilevered over the corresponding notches 40 recessed into the core inner surface 22.

The advantage of molding is the simultaneous production of all the features of the core in a relatively simple and inexpensive molded piece. And, the forks 34 are structurally uncoupled from the core inner surface by the recessed notch 40 for permitting their resilient compression during mounting. The forks are integrally formed with the remainder of the corresponding ribs 28 and are thusly structurally mounted to the body of the core for enhanced strength.

The molded forks 34 are initially splayed outwardly without compression, and have little if any residual stress therein. Only during mounting of the core on the spindle are the forks compressed under side bending loads for effecting the resulting detent latching forces at their end faces.

The exemplary configuration of the fork 34 illustrated in FIG. 6 includes rectangular beam tines forming an integral extension of the rectangular beam rib 28. The radial height of the tines is preferably equal to that of the main rib at the junction therewith, and the corresponding circumferential width of the two tines is collectively no greater than the width of the main rib at the junction therewith. In this way, the fork 34 may be compressed together within the full rectangular profile of the main rib and pushed completely through the corresponding spindle slot but for the stopping action of the wedges 42.

During the manufacturing process, the individual cores 14 illustrated in FIG. 1 may be suitably molded in plastic in a unitary construction, and then the sheet roll 16 may be conventionally wound around the outer surface of the core to complete the sheet wound core. The sheet roll may have any conventional configuration, such as thermal transfer ribbon for use in a corresponding thermal printer.

The spindle 12 of the printer illustrated in FIG. 1 is readily accessible by a user so that a wound core 14 may be simply mounted on the spindle by being inserted axially thereover, with the three ribs 28 being aligned and inserted through the corresponding three spindle slots 30. The core is pushed onto the spindle until the wedges 42 axially abut the perimeter of the forward flange 36 at which position the two bottom forks 34 are resiliently compressed and latched in the cooperating steps behind the forward flange 36.

The printer is then operated in a conventional manner for rotating the spindle for in turn rotating the core therewith for dispensing the sheet roll 16 for printing therewith until the sheet roll is eventually depleted.

The depleted empty core may then be simply removed by pulling the core from the spindle and overcoming the frictional retention force of the resiliently compressed forks. The retention force effected by the compressed forks is sufficient for maintaining accurate alignment of the core on the spindle during normal printer operation, but is readily overcome by the force of removal exerted by the user.

An additional advantage of the improved core illustrated in FIG. 1 is that the wedges 42 prevent incorrect assembly of the core on the spindle since the core may be mounted on the spindle in only one direction with the first opening 24 traveling first over the spindle until the second opening 26 is in position over the forward end of the spindle. The wedges 42 prevent the second opening of the core from being inserted firstly over the forward end of the spindle in view of the smaller internal diameter created by the wedges.

Accordingly, the beveled ribbed core disclosed above may have various configurations of the forks for introducing detent latching in any of the three possible positions of the ribs in the three spindle slots. And, the separately located wedges precisely stop mounting movement of the core while also precisely locating the compressed forks for ensuring their proper performance. The resulting core enjoys simplicity of construction, and may be conveniently manufactured in a relatively inexpensive unitary molded piece for reducing the overall cost of the core and sheet roll wound thereon for promoting competitive advantage. And, the beveled forks permit proper operation thereof without regard to normal variations in molding dimensions of the core features.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims in which we claim:

1. A core for supporting a wound sheet roll on a spindle, comprising:

a tubular body including an annular outer surface for receiving said sheet roll wound therearound, an annular inner surface defining a bore for receiving said spindle, and first and second openings at axially opposite ends thereof;

a plurality of circumferentially spaced apart ribs projecting radially inwardly from said inner surface and extending axially between said first and second openings for nesting in corresponding slots in said spindle; and each of said ribs includes a fork having two circumferentially splayed apart tines extending axially outwardly from said rib inside said second opening, and said tines have beveled end faces for frictionally engaging a step at an entrance to one of said spindle slots to frictionally retain said core axially on said spindle.

2. A core according to claim 1 further comprising a wedge projecting radially inwardly from said inner surface at said second opening for axially abutting said spindle to limit assembly of said core on said spindle.

3. A core according to claim 2 wherein said wedge is spaced circumferentially from said ribs.

4. A core according to claim 3 wherein said inner surface includes a plurality of notches adjacent said second opening, and said rib forks are cantilevered inboard over corresponding notches.

5. A core according to claim 4 wherein said beveled end faces diverge axially between said second and first openings at an acute inclination angle for providing a cam surface to engage said step.

6. A core according to claim 5 wherein said forks are resilient, and are splayed in circumferential width for being circumferentially compressed by said spindle slot as said core is mounted axially over said spindle.

7. A core according to claim 6 wherein said ribs include a substantially axially straight portion from said core first opening to said notch adjacent said core second opening, and said fork tines are axially straight over said notch and splayed circumferentially outwardly from said rib straight portion.

8. A core according to claim 7 wherein said fork end faces are beveled at an inclination angle in a range of about 15°–300°.

9. A core according to claim 8 wherein said fork end faces are beveled at about 22°.

10. A core according to claim 7 in combination with said spindle, with said ribs being disposed in said spindle slots, and said fork tines being circumferentially compressed to frictionally engage opposite sides of said slots, and said wedge axially abuts said spindle between adjacent ones of said slots.

11. A combination according to claim 10 wherein said spindle includes a conical forward flange, with said spindle slots extending aft from a perimeter thereof and one of said sides being offset at said flange to effect said step, and at least one of said fork tines engages an aft edge of said flange at said step for providing frictional retention force.

12. A core according to claim 7 further comprising three of said ribs each having forked distal ends cantilevered over corresponding notches in said core inner surface for correspondingly frictionally engaging three slots in said spindle.

13. A core according to claim 12 further comprising three of said wedges spaced circumferentially between corresponding pairs of said forked ribs.

14. A core according to claim 13 wherein said three forked ribs are equiangularly circumferentially spaced apart from each other, and said three wedges are equiangularly circumferentially spaced apart from each other, and each of said wedges is equiangularly spaced apart between corresponding pairs of said forked ribs.

15. A core according to claim 7 further comprising said sheet roll wound around said outer surface thereof.

16. A core according to claim 15 wherein said sheet roll comprises thermal transfer ribbon.

17. A method of making said core according to claim 7 comprising molding said core in a unitary assembly including said forks cantilevered over said notches (40), and said ribs and wedge projecting radially inwardly from said inner surface.

18. A method according to claim 17 wherein said fork tines are molded integrally with said rib straight portion and have equal height therewith, and corresponding widths collectively no greater than the width of said rib straight portion thereat.

19. A core for supporting a wound sheet roll on a spindle, comprising:

a tubular body including an annular outer surface for receiving said sheet roll wound therearound, an annular inner surface defining a bore for receiving said spindle, and first and second openings at axially opposite ends thereof;

three circumferentially spaced apart ribs projecting radially inwardly from said inner surface and extending axially between said first and second openings for nesting in three corresponding slots in said spindle; and each of said ribs includes a fork having two circumferentially splayed apart tines extending axially outwardly from said rib inside said second opening, and said tines have beveled end faces for frictionally engaging a step at an entrance to one of said spindle slots to frictionally retain said core axially on said spindle.

20. A core according to claim 19 further comprising three circumferentially spaced apart wedges inclined radially inwardly from said inner surface at said second opening for axially abutting said spindle to limit assembly of said core on said spindle.

21. A core according to claim 20 wherein said beveled end faces diverge axially between said second and first openings at an acute inclination angle for providing a cam surface to engage said step.

22. A core according to claim 21 wherein each of said forks is resilient, and splayed in circumferential width for being circumferentially compressed by corresponding spindle slots as said core is mounted axially over said spindle.

23. A core according to claim 22 wherein said inner surface includes a plurality of notches adjacent said second opening over which corresponding ones of said rib forks are cantilevered.

* * * * *

UNITED STATES PATENT AND TRADEMARK OFFICE

CERTIFICATE OF CORRECTION

PATENT NO. : 6,609,677 B2
DATED : August 26, 2003
INVENTOR(S) : Seybold, J.M. and Puckett, R. D.

It is certified that error appears in the above-identified patent and that said Letters Patent is hereby corrected as shown below:

Column 8,
Line 48, delete "15º - 300º" and insert -- 15º - 30º --

Signed and Sealed this

Seventeenth Day of August, 2004

JON W. DUDAS
*Acting Director of the United States Patent and Trademark Office*